United States Patent [19]

Sibata et al.

[11] Patent Number: 4,747,763

[45] Date of Patent: May 31, 1988

[54] ROTOR ASSEMBLY OF ROOTS PUMP

[75] Inventors: Takuo Sibata, Okazaki; Hisao Shirai, Aichi; Yoshio Kuroiwa, Toyota; Katsuro Harada, Tajimi; Kichiro Kato, Toyota; Naofumi Masuda, Nagoya, all of Japan

[73] Assignee: Toyota Jidosha Kabushiki Kaisha, Toyota, Japan

[21] Appl. No.: 870,746

[22] Filed: Jun. 4, 1986

[30] Foreign Application Priority Data

Jun. 7, 1985 [JP] Japan ..... 60-86454

[51] Int. Cl.[4] ..... F04C 18/00; F16D 1/00

[52] U.S. Cl. ..... 418/206; 403/282; 403/359; 403/379

[58] Field of Search ..... 418/206; 403/319, 379, 403/282, 359

[56] References Cited

U.S. PATENT DOCUMENTS

| | | | |
|---|---|---|---|
| 2,611,323 | 9/1952 | Digney | 418/179 |
| 2,754,050 | 7/1956 | Wellington | 418/206 |
| 3,275,225 | 9/1966 | Schultz | 418/150 |
| 3,290,918 | 12/1966 | Weasler | 403/359 |
| 4,376,333 | 3/1983 | Kanamaru | 403/282 |
| 4,464,101 | 8/1984 | Shibuya | 418/179 |
| 4,509,381 | 4/1985 | Ikemoto | 403/282 |

FOREIGN PATENT DOCUMENTS

| | | | |
|---|---|---|---|
| 0135257 | 6/1984 | European Pat. Off. . | |
| 59-63390 | 11/1982 | Japan . | |
| 975650 | 11/1964 | United Kingdom | 403/379 |
| 2017865 | 10/1979 | United Kingdom | 403/359 |

OTHER PUBLICATIONS

A. Ehrhardt and H. Franke "Lueger, Lexikon der Technik", Band 1, *Grundlagen des Maschinenbaues*, Deutsche Verlagsanstalt–Stuttgart, 1960, pp. 617–618, Ordnungswort Vielnutverbindungen.

*Primary Examiner*—Carlton R. Croyle
*Assistant Examiner*—Jane E. Obeo
*Attorney, Agent, or Firm*—Oblon, Fisher, Spivak, McClelland & Maier

[57] ABSTRACT

A Roots pump having a plurality of rotor assemblies each including a light-alloy rotor, a steel shaft press-fitted in a bore of the rotor and a lock pin which is inserted through the rotor and the shaft to prevent removal of the shaft from the rotor. The lock pin is located substantially at an axial center of a press-fitted portion of the shaft accommodated the axial bore. The shaft has a timing gear at one end thereof for meshing with a timing gear of the shaft of the adjacent rotor assembly. The shaft further has a plurality of engagement teeth provided at one of opposite ends of the press-fitted portion on the side of the timing gear. The engagement teeth are at least partially embedded in an inner surface defining the axial bore of the rotor, upon press-fitting of the press-fitted portion in the axis bore, to thereby prevent a rotational movement of the shaft relative to the rotor.

9 Claims, 2 Drawing Sheets

ROTOR ASSEMBLY OF ROOTS PUMP

BACKGROUND OF THE INVENTION

1. Field of the Art

The present invention relates generally to a rotor assembly incorporated in a Roots pump, and more particularly to a technique for securely mounting a rotor made of light alloy on a support shaft made of steel.

2. Related Art Statement

A commonly known pump of a Roots type uses a plurality of rotor assemblies each of which includes a rotor, and a support shaft for supporting the rotor. The rotor and the shaft are fixed to each other such that the shaft is press-fitted in an axial bore formed concentrically through the rotor, while a lock pin is inserted through the rotor and the shaft in a direction intersecting the axis of the rotor assembly. Usually, the rotor is formed of a comparatively soft, light alloy material such as aluminum alloy for reduced inertia, while the support shaft is formed of a steel material for sufficient rigidity.

3. Problems Solved by the Invention

In a rotor assembly constructed as discussed above, the rotor and the support shaft have a relatively large difference in the thermal expansion coefficient. Accordingly, the rotor shrinks to a greater extent than the support shaft when the rotor assembly is cooled as in a thermal cycle shock test, wherein the rotor and the shaft are subject to a considerable change in temperature. As a result, the amount of interference between the inner surface of the rotor and the outer surface of the shaft is increased as compared with the nominal or predetermined suitable amount of interference given upon press fitting engagement of the shaft with the bore in the rotor. The increased amount of interference results in an increased stress (tensile stress) exerted to the rotor in its circumferential direction. The tensile stress may exceed the yield strength of the rotor material, causing plastic deformation of the rotor during cooling of the rotor assembly. Consequently, when the rotor assembly is subsequently exposed to a higher temperature, the amount of interference between the rotor and the shaft is reduced because of the plastic deformation, and the fastening force or surface pressure between the two members is accordingly reduced. This may permit a slight degree of relative rotational rattling movement between the rotor and the shaft in operation of the pump. While rotational and axial movements of the rotor relative to the shaft are inhibited by the lock pin, the pin holes in which the lock pin is inserted may be enlarged due to wear since the drive torque is transmitted to the rotor through the lock pin. Therefore, relative movements between the rotor and the shaft may take place if the press-fit force therebetween is reduced below the critical lower limit.

The above-indicted lock pin which bears the rotor drive torque is positioned at an axially middle portion of the rotor assembly, while the drive torque is imparted to the support shaft through a timing gear which is fixed to one of opposite ends of the shaft. Thus, there is a considerably distance between the timing gear and the lock pin, which may more or less cause a twisting of a portion of the shaft due to a torsional force applied to that portion. This is a cause for another inconvenience of the known Roots pump that a predetermined relative angular phase of the plurality of rotor assemblies may be lost during operation of the pump.

The inconveniences indicated above may give rise to an interference between the adjacent rotor assemblies, which leads to reduction of durability of the pump.

SUMMARY OF THE INVENTION

It is therefore an object of the present invention to provide a Roots pump which is improved in durability.

According to the present invention which was developed in the light of the prior art inconveniences discussed above, there is provided a Roots pump having a plurality of rotor assemblies each of which includes a rotor made of light alloy having an axial bore formed therethrough, a support shaft made of steel which has a timing gear fixed to one of opposite axial ends thereof and which is press-fitted in the axial bore to support the rotor, and a lock pin which is inserted through the rotor and the shaft in a direction intersecting an axis of rotation of the rotor assembly, to prevent removal of the shaft from the rotor, wherein the lock pin is located substantially at an axial center of a press-fitted portion of the shaft which is accommodated in the axial bore, and wherein the shaft has a plurality of engagement teeth provided at one of opposite ends of the press-fitted portion of the shaft on the side of the timing gear. The engagement teeth are at least partially embedded in an inner surface defining the axial bore of the rotor, upon press-fitting of the press-fitted portion in the axial bore, to thereby prevent a rotational movement of the shaft relative to the rotor.

In the Roots pump of the present invention constructed as described above, the engagement teeth provided at one end of the press-fitted portion of the shaft on the side of the timing gear are forced against the inner surface of the axial bore in the rotor, at their surfaces which include surfaces inclined with respect to the tangential direction of the shaft. The amount of increase in the interference between these inclined surfaces of the teeth and the inner surface of the rotor is significantly smaller than that between the tangential surfaces (perpendicular to the radial direction of the shaft) of the teeth and the inner surface of the rotor. As a result, the tensile stresses which are exerted to the rotor in its circumferential direction during cooling of the rotor assembly in a thermal shock test, will not exceed the yield strength of the material of the rotor at its parts contacting the inclined surfaces of each tooth of the engagement teeth. Thus, the engagement teeth contribute to protecting the rotor from plastic deformation due to such tensile stresses, and consequently to preventing reduction in the fastening force between the rotor and the support shaft.

In the instant arrangement of the rotor assembly, a torque imparted to the timing gear is transmitted to the rotor primarily through the press-fit engagement of the engagement teeth with the rotor. Therefore, pin holes for the lock pin are protected from enlargement due to wear, whereby a relative rotational movement of the rotor and the shaft is eliminated. Thus, the Roots pump constructed according to the present invention is adapted to avoid an interference between the adjacent rotor assemblies or between the rotor assembly and the stator housing of the pump.

Further, since the engagement teeth are provided at the end of the press-fit portion of the shaft on the side of the timing gear, a torsional force created by the torque imparted to the timing gear is exerted to a portion of the shaft between the engagement teeth and the timing gear, rather than between the lock pin and the timing gear. In other words, the length of a portion of the shaft to which the torsional force is exerted is reduced, and consequently the amount of twisting of the shaft due to the torsional force is accordingly decreased. Hence, the rotor assemblies maintain a predetermined angular phase relative to each other, and are free of an interference between the rotors.

A further advantage of the instant Roots pump is attributed to an arrangement wherein the lock pin is positioned substantially at the axial center of the press-fit portion of the shaft. That is, an axial displacement of the rotor relative to the shaft, which may be caused by a difference in the thermal expansion coefficient between the two members, occur evenly on both sides of the lock pin when the rotor assembly is subject to a temperature change. Therefore, the axial stress to be exerted to the rotor and the consequent deformation thereof are mitigated.

As described above, the Roots pump according to the principle of the present invention is protected from an interference between the adjacent rotor assemblies or between the rotor assemblies and the stationary housing of the pump, and is thus improved in durability. This is the eventual advantage offered by the present invention.

According to one feature of the invention, the plurality of engagement teeth are spaced from each other in a circumferential direction of the shaft. In one form of the Roots pump incorporating this feature, each of the engagement teeth has a top surface perpendicular to a radial direction of the shaft, and a pair of inclined side surfaces extending from opposite ends of the top surface.

According to another feature of the invention, the axial bore includes a first hole corresponding to a part of the press-fitted portion of said shaft at which the engagement teeth are provided, and a second hole corresponding to the rest of the press-fitted portion of the shaft.

In one form of the above feature of the invention, a diameter of the first hole is larger than that of the second hole.

According to a further feature of the invention, the engagement teeth are provided in the form of a gear having gear teeth which are spaced from each other in a circumferential direction of the shaft. In this case, it is preferred that a diameter of the first hole is smaller than a diameter of an addendum circle of the gear teeth, but is larger than a diameter of a dedendum circle of the gear teeth.

In accordance with one arrangement according to the above feature of the invention, each of the gear teeth has a top surface perpendicular to a radial direction of the shaft, and a pair of inclined side surfaces which extend between opposite ends of the top surface and an outer circumferential surface of the shaft.

BRIEF DESCRIPTION OF THE DRAWINGS

The above and optional objects, features and advantages of the present invention will be better understood by reading the following detailed description of a preferred embodiment of the invention, when considered in connection with the accompanying drawings, in which.

DETAILED DESCRIPTION OF THE PREFERRED EMBODIMENT

The preferred embodiment of the present invention will be described in detail referring to the accompanying drawings.

Figure 1:
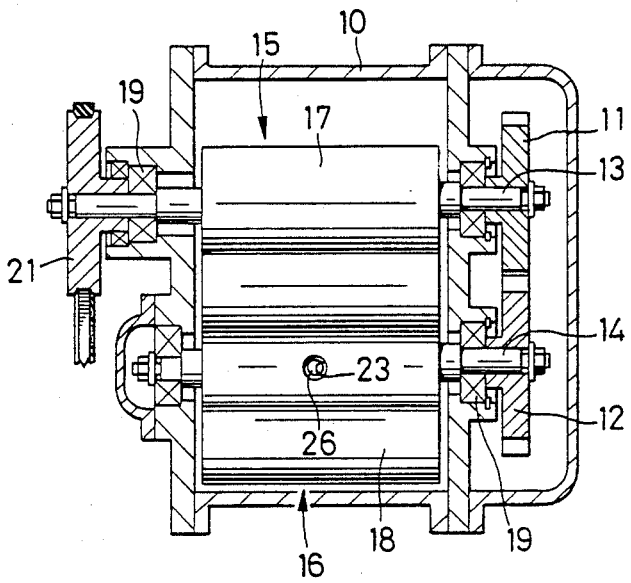
FIG. 1 is a side elevational view partly in cross section of a Roots pump incorporating rotor assemblies constructed according to one embodiment of the invention.
Figure 2:
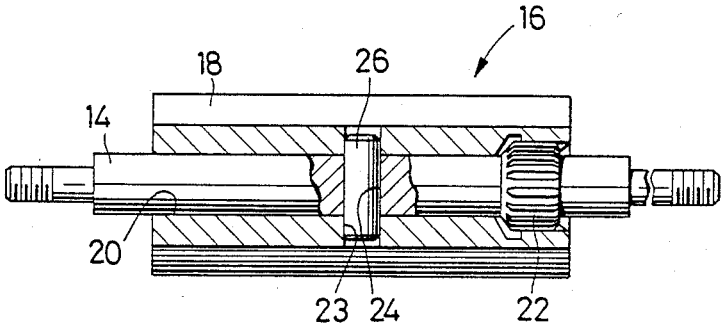
FIG. 2 is a partially cutaway cross sectional view of one of the two rotor assemblies of the pump of FIG. 1.
Figure 3:
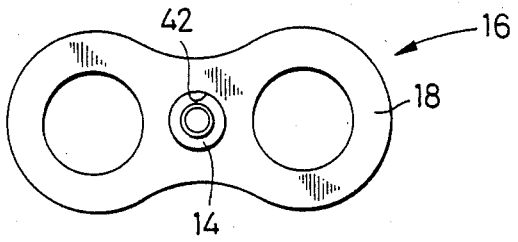
FIG. 3 is an end elevational view of the rotor assembly of FIG. 2, taken along the axis of the rotor assembly.

There is shown in the side elevational view of FIG. 1 a Roots pump constructed according to the invention. In the figure, reference numeral 10 designates a stator housing of the Roots pump in which a pair of rotor assemblies 15, 16 are rotatably supported by means of bearings 19. The rotor assembly 15 includes a rotor 17 and a support shaft 13. The rotor 17 has a transverse cross sectional shape similar to the shape of a cocoon or a peanut shell, as illustrated in FIG. 3, and is made of a light alloy material such as aluminum alloy. The support shaft 13 is made of a steel material and has a timing gear 11 fixed to one of opposite axial ends thereof. Similarly, the rotor assembly 16 includes a rotor 18, and a support shaft 14 having a timing gear 12 which meshes with the timing gear 11 and has the same number of teeth as the gear 11. A drive pulley 21 is fixed to the other end of the support shaft 13. A rotary motion imparted to the drive pulley 21 is transmitted to the support shaft 13, and to the support shaft 14 via the timing gears 11, 12, whereby the two rotor assemblies 15, 16 are rotated in the opposite directions at the same velocity, while maintaining a predetermined relative angular phase.

Figure 4:
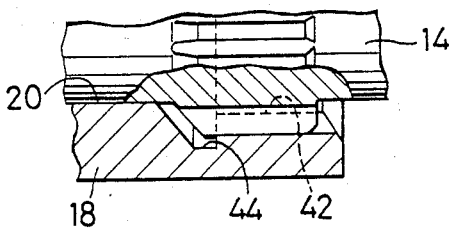
FIG. 4 is a fragmentary enlarged view of the rotor assembly of FIG. 2.
Figure 5:
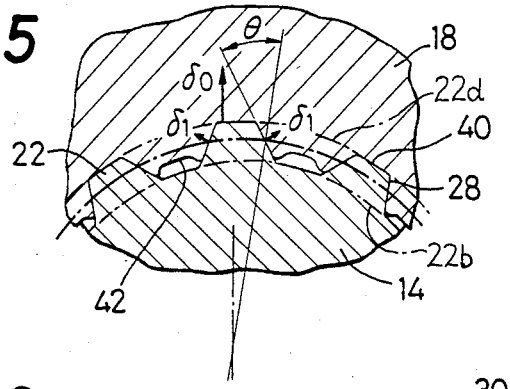
FIG. 5 is a fragmentary view in transverse cross section of the rotor assembly, illustrating press-fit engagement between a rotor and engagement teeth on a support shaft of the rotor assembly of FIG. 2.

Since the two rotor assemblies 15 and 16 are identically constructed, the following detailed description refers only to the rotor assembly 16, which is illustrated in FIG. 2 through FIG. 5. The rotor 18 has an axial bore formed axially therethrough. The axial bore includes a first hole 42 and a second hole 20 which is smaller in diameter than the first hole 42. The steel support shaft 14 is inserted through the axial bore 20, 42 such that the shaft 14 is press-fitted in the axial bore 20, 42 over a predetermined length. A portion of the shaft 14 press-fitted in the axial bore 20, 42 will be referred to as "press-fitted portion". The shaft 14 has a plurality of engagement teeth 22 in the form of a gear integrally formed at one of opposite axial ends of the press-fitted portion on the side of the timing gear 12. The engagement teeth 22 are formed so as to extend in the axial direction of the shaft 14, and are evenly spaced from each other in the circumferential direction of the support shaft 14, as depicted in FIG. 5. The diameter of the second hole 20 and the outside diameter of the support shaft 14 are determined so that the shaft 14 engages the second hole 20 in a close or tight fit manner. The first hole 42 is formed to accommodate the engagement teeth 22 with an interference fit. The diameter of the first hole 42 is smaller than the diameter of the addendum circle **22*a* (outside diameter) of the teeth 22, but larger than the diameter of the dedendum circle 22*b***

(root circle) of the teeth 22. With the support shaft 14 forced into the axial bore 20, 42, the teeth 22 are partially embedded in the inner surface defining the first hole 42 as shown in FIGS. 4 and 5. The rotor 18 and the support shaft 14 have, at their axially central parts, pin holes 23 and 24, respectively. These pin holes 23, 24 are formed so as to extend in a direction intersecting the axis of rotation of the rotor assembly 16. These pin holes 23, 24 are aligned with each other to accommodate a lock pin 26 after the support shaft 14 is press-fitted in the bore 20, 42. Thus, the lock pin 26 is located at the axial center of the press-fitted portion of the shaft 14. As shown in FIG. 4, an annular groove 44 is formed between the second hole 20 and the first hole 42.

As indicated above, the support shaft 14 is forced into the second hole 20 for a tight fit, while at the same time the top lands of the engagement teeth 22 formed near the timing gear 12 are forcibly embedded into the inner wall of the rotor 18 defining the first hole 42. In this condition, a rotational motion of the support shaft 14 relative to the rotor 18 is prevented primarily by the interference fit of the engagement teeth 22 in the first hole 42, while a longitudinal displacement of the support shaft 14 relative to the rotor 18 is prevented primarily by the lock pin 26 inserted through the pin holes 23, 24.

Figure 6:
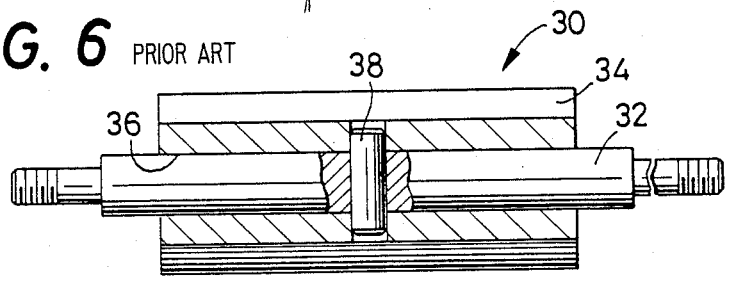
FIG. 6 PRIOR ART
FIG. 6 is a view corresponding to FIG. 2, showing a rotor assembly of a known Roots pump.

In a rotor assembly 30 of a known Roots pump shown in FIG. 6 for comparative purpose, a steel support shaft 32 is press-fitted in a bore 36 formed in a rotor 34. In the meantime, a lock pin 38 is inserted in holes formed in the shaft 32 and the rotor 34, to prevent a relative rotational motion between the shaft and rotor 32, 34. Since there exists a relatively large difference in the thermal expansion coefficient between the rotor 34 made of a light alloy material and the support shaft 32 made of a steel material, the rotor 34 shrinks to a greater extent than the support shaft 32 when the rotor assembly 30 is cooled during a thermal cycle shock test involving a large degree of temperature change. As a result, the amount of interference between the inner surface of the rotor 34 and the outer surface of the shaft 32 is increased as compared with the predetermined amount of interference given by the press-fit or interference fit of the shaft 32 in the bore 36 in the rotor 34. This increase in the amount of interference causes a stress (tensile stress) to be exerted to the rotor 34 in the circumferential direction of the bore 36, which stress may exceeds the yield strength of the material of the rotor 34, resulting in plastic deformation of the rotor 34. With this plastic deformation, the interference between the shaft 32 and the rotor 34 cannot be restored to the intially given amount after the rotor assembly 30 is subsequently exposed to a higher temperature. Thus, the shaft 32 and the rotor 34 may suffer insufficiency of a fastening force or surface pressure therebetween, and the rotor assembly 30 is liable to have a slight relative movement between the shaft 32 and the rotor 34.

Contrary to the rotor assembly 30 of the known Roots pump, the illustrated rotor assembly 16 maintains a sufficient amount of interference between the steel support shaft 14 and the light-alloy rotor 18 even after the assembly 16 is subjected to a thermal cycle test, since the engagement teeth 22 are partially forced in the wall of the rotor 18 as previously discussed. Described more specifically, each of the engagement teeth 22 has a top surface 40 perpendicular to the radial direction of the shaft 14, and a pair of inclined side surfaces 28 which extend between the opposite ends of the top surface 40 (as viewed circumferentially of the shaft 14) and the outer circumferential surface of the shaft 14.

Although the amount of interference at the top surface 40 of each tooth 22 may be slightly reduced after the thermal cycle test, the amount of decrease in the interference at the inclined surfaces 28 is not so much as that at the top surface 40. Namely, the amount of increase in the interference at the inclined surfaces 28 upon cooling of the rotor assembly 16 is significantly smaller than that at the top land surface 40 which is tangent to the circumference of the support shaft 14 (normal to the radial direction of the shaft 14). Therefore, the circumferential tensile stress exerted to the rotor 18 at the inclined surfaces 28 due to a larger degree of shrinkage of the rotor 18 during cooling of the assembly 16 is less likely to exceed the yield strength of the rotor 18, and consequently the decrease in the amount of interference at the inclined surfaces 28 after the assembly 16 is exposed to a higher temperature is held relatively small. Thus, there remains a sufficient fastening force or surface pressure between the support shaft 14 and the rotor 18 even after the rotor assembly 16 is subjected to the thermal cycle test.

Described more particularly, the following equation represents an amount of increase $\delta_1$ in the interference between the shaft 14 and the rotor 18, as measured in the direction perpendicular to the inclined surfaces 28, which increase takes place upon cooling of the rotor assembly 16, due to a difference in the thermal expansion coefficient between the shaft 14 and the rotor 18:

$$\delta_1 = \delta_0 \sin \theta$$

where, $\theta$: pressure angle of teeth 22

$\delta_0$: amount of increase in the interference in the radial direction of the support shaft 14

Thus, $\sin \theta << 1$, and therefore $\delta_1 << \delta_0$. Hence, the amount of increase in the interference upon cooling of the rotor assembly 16 is smaller in the direction perpendicular to the inclined surface 28 than in the radial direction of the shaft 14. This contributes to prevention of the plastic deformation of the rotor 18 by a tensile stress exerted thereto due to a difference in shrinkage between the shaft 14 and the rotor 18 upon cooling of the rotor assembly 16.

Unlike the rotor assembly 30 of FIG. 6 wherein a torque imparted to the support shaft 32 through a timing gear (not shown) is transmitted to the rotor 34 primarily through the lock pin 38, the rotor assembly 16 of the illustrated Roots pump of the invention is adapted such that the torque imparted to the support shaft 14 through the timing gear 12 is transmitted to the rotor 18 primarily through the press-fit or interference engagement of the engagement teeth 22 with the inner surface of the rotor 18. According to this arrangement, the lock pin 26 is subject to a reduced load, and the pin hole 23 formed in the rotor 18 is less likely to be enlarged due to wear.

While the rotor 18 may be deformed in its longitudinal axial direction by its axial displacement relative to the steel shaft 14 due to the previously indicated difference in thermal expansion coefficient upon a temperature change, such an axial deformation of the rotor 18 is avoided according to the instant arrangement, in which the lock pin 26 is positioned at the axially midpoint of the press-fitted portion of the shaft 14. In other words, the longitudinal displacement of the rotor 18 relative to the shaft 14 takes place evenly on both sides of the lock pin 26, whereby the rotor 18 is protected from deformation due to uneven axial stresses on the right and left sides of the pin 26.

As described above, the rotor assemblies 15 and 16 are protected from undesirable relative movements or deformation of the rotor 17, 18 relative to the shaft 13, 14, which would be conventionally caused if the assemblies 15, 16 are subjected to a considerably large change in temperature. Thus, the two rotor assemblies 15, 16 are protected from an interference between the two rotors 17, 18.

When the shaft 14 is rotated with a torque imparted thereto through the timing gear 12, the shaft 14 is subjected to a torsional force between the engagement teeth 22 and the timing gear 12, since the torque is transmitted to the rotor 18 primarily through the engagement teeth 22 with the rotor 18. In this connection, it is noted that the teeth 22 are formed at one of opposite ends of the press-fitted portion of the shaft 14, which one end is relatively close to the timing gear 12, that is, the distance between the teeth 22 and the timing gear 12 is relatively short, whereby the amount of twisting of the shaft 14 is held small. Thus, the instant Roots pump is capable of maintaining the predetermined relative angular phase of the rotor assemblies 15, 16.

In the illustrated embodiment, the rotor assemblies 15 and 16 are suitably protected from an interference between the rotors 17, 18 due to twisting of the shaft 14 which is driven by the shaft 13 via the timing gears 11, 12.

As is apparent from the foregoing description, the illustrated Roots pump has unique provisions for avoiding an interference between the rotor assemblies 15, 16, which may be caused for the various reasons indicated above. The Roots pump is therefore improved in durability.

While the present invention has been described in its preferred embodiment for illustrative purpose only, it is to be understood that various changes may be made in the invention without departing from the spirit and scope of the invention defined in the appended claims.

What is claimed is:

1. A Roots pump having a plurality of rotor assemblies each of which includes a rotor made of light alloy having an axial bore formed therethrough, a support shaft made of steel which has a timing gear fixed to one of opposite axial ends thereof and which has a press-fitted portion press-fitted in the axial bore to support the rotor, and a lock pin which is inserted through the rotor and the support shaft in a direction intersecting an axis of rotation of the rotor assembly, to prevent removal of the support shaft from the rotor, wherein the improvement comprises:

said lock pin being located substantially at an axial center of said press-fitted portion of said support shaft which is press-fitted in said axial bore;

said axial bore comprising a first hole and a second hole; and said press-fitted portion of said support shaft having a plurality of engagement teeth formed at one of opposite ends thereof which is nearer to said timing gear than the other end, said engagement teeth being at least partially embedded in an inner surface defining said first hole of said axial bore of the rotor, to thereby prevent a rotation movement of said support shaft relative to said rotor, said press-fitted portion further having a part which extends through said second hole of said axial bore of the rotor and through which said lock pin is inserted.

2. A Roots pump according to claim 3, wherein a diameter of said first hole is larger than that of said second hole.

3. A Roots pump according to claim 1, wherein said plurality of engagement teeth are spaced from each other in a circumferential direction of said shaft.

4. A Roots pump according to claim 3, wherein each of said plurality of engagement teeth has a top surface perpendicular to a radial direction of said shaft, and a pair of inclined side surfaces extending from opposite ends of said top surface.

5. A Roots pump according to claim 3, wherein said plurality of engagement teeth are provided in the form of a gear having gear teeth which are spaced from each other in a circumferential direction of said shaft.

6. A Roots pump according to claim 5, wherein a diameter of said first hole is smaller than a diameter of an addendum circle of said gear teeth, but is larger than a diameter of a dedendum circle of said gear teeth.

7. A Roots pump according to claim 5, wherein each of said gear teeth has a top surface perpendicular to a radial direction of said shaft, and a pair of inclined side surfaces which extend between opposite ends of said top surface and an outer circumferential surface of said shaft.

8. A Roots pump having a plurality of rotor assemblies each of which includes a rotor made of light alloy having an axial bore formed therethrough, a support shaft made of steel which has a timing gear fixed to one of opposite axial ends thereof and which has a press-fitted portion press-fitted in the axial bore to support the rotor, and a lock pin which is inserted through the rotor and the support shaft in a direction intersecting an axis of rotation of the rotor assembly, to prevent removal of the support shaft from the rotor, said timing gear is fixed to said one axial end of said support shaft such that the timing gears of said plurality of rotor assemblies are held in meshing engagement with each other, so that a torque to drive said plurality of rotor assemblies is transmitted through said timing gears, wherein the improvement comprises:

said lock pin being located at a substantially axially central portion of said press-fitted portion of said support shaft;

said axial bore comprising a first hole, and a second hole communicating with said first hole and having a diameter smaller than that of the said first hole; and said press-fitted portion of said support shaft including a gear formed at one of opposite ends thereof which is nearer to said timing gear than the other end, said gear having a plurality of engagement teeth which are spaced apart from each other in a circumferential direction of said support shaft, said engagement teeth being at least partially embedded in an inner surface defining said first hole of said axial bore of the rotor, said press-fitted portion further having a part which extends through said second hole of said axial bore of the rotor and through which said lock pin is inserted.

9. A Roots pump according to claim 8, wherein said support shaft of said each rotor assembly is made of an aluminum alloy.

* * * * *

UNITED STATES PATENT AND TRADEMARK OFFICE

CERTIFICATE OF CORRECTION

PATENT NO. : 4,747,763

DATED : May 31, 1988

INVENTOR(S) : Takao SIBATA, et al.

It is certified that error appears in the above-identified patent and that said Letters Patent is hereby corrected as shown below: On the title page The name of the third inventor is spelled incorrectly. It should read as follows:

-- Yosio Kuroiwa --

Signed and Sealed this

Twenty-fifth Day of October, 1988

*Attest:*

DONALD J. QUIGG

*Attesting Officer*

*Commissioner of Patents and Trademarks*